United States Patent [19]

Kondo

[11] 4,210,264

[45] Jul. 1, 1980

[54] IMMERSION NOZZLE FOR CONTINUOUS CASTING OF MOLTEN STEEL

[75] Inventor: Masanao Kondo, Gifu, Japan

[73] Assignee: Akechi Taikarenga Kabushiki Kaisha, Gifu, Japan

[21] Appl. No.: 31,063

[22] Filed: Apr. 18, 1979

[30] Foreign Application Priority Data

Apr. 26, 1978 [JP] Japan ..... 53-50330

[51] Int. Cl.[2] ..... B22D 11/10

[52] U.S. Cl. ..... 222/591; 164/437

[58] Field of Search ..... 164/437, 438, 439; 222/591

[56] References Cited

FOREIGN PATENT DOCUMENTS

| | | | |
|---|---|---|---|
| 48-46522 | 7/1973 | Japan . | |
| 48-28254 | 8/1973 | Japan | 164/437 |
| 49-28568 | 7/1974 | Japan . | |
| 49-48047 | 12/1974 | Japan | 164/437 |
| 50-00007 | 1/1975 | Japan . | |
| 50-39628 | 4/1975 | Japan | 164/437 |
| 50-53415 | 5/1975 | Japan . | |
| 50-66432 | 6/1975 | Japan | 164/437 |
| 52-76312 | 6/1977 | Japan . | |

*Primary Examiner*—Robert D. Baldwin
*Assistant Examiner*—K. Y. Lin
*Attorney, Agent, or Firm*—Frishauf, Holtz, Goodman & Woodward

[57] ABSTRACT

An immersion nozzle for continuous casting of molten steel, which comprises: a nozzle body comprising an aluminagraphite refractory and a refractory layer excellent in erosion resistance against a molten mold power, said refractory layer being arranged so as to be integral with said nozzle body and flush with the outer surface of said nozzle body at the outside portion of said nozzle body in contact, when the lower portion of said immersion nozzle being immersed into molten steel in a mold, with a molten mold powder layer on the meniscus of said molten steel; said refractory layer arranged at said outside portion of said nozzle body consisting essentially of, in weight percentage;

Carbon (C): from 2 to 10%,

Zirconia ($ZrO_2$): from 70 to 90%,

At least one compound selected from the group consisting of silicon carbide (SiC) and amorphous silica ($SiO_2$): from 5 to 27% and, Incidental impurities: up to 3%.

1 Claim, 4 Drawing Figures

IMMERSION NOZZLE FOR CONTINUOUS CASTING OF MOLTEN STEEL

REFERENCE TO PATENTS, APPLICATIONS AND PUBLICATIONS PERTIENT TO THE INVENTION

So far as we know, prior documents pertinent to the present invention are as follows:

(1) Japanese Patent Publication No. 28,568/74 of July 27, 1974;

(2) Japanese Patent Utility Model Provisional Publication No. 46,522/73 of July 3, 1973; and, (3) Japanese Patent Provisional Publication No. 53,415/75 of May 22, 1975.

The prior arts disclosed in the above-mentioned prior documents will be commented on the "BACKGROUND OF THE INVENTION" presented hereafter.

Each one copy of said prior documents is attached hereto.

FIELD OF THE INVENTION

The present invention relates to an immersion nozzle, which can serve for a long period of time, attached as a protrusion substantially vertically to the bottom of a tundish for teeming molten steel fed to said tundish from a ladle into a mold in continuous casting of molten steel.

BACKGROUND OF THE INVENTION

A mold powder and an immersion nozzle are popularly used in continuously casting molten steel.

For example, a mold powder comprising 35.46 wt.% $SiO_2$, 6.08 wt.% $Al_2O_3$, 36.87 wt.% CaO, 8.05 wt.% $Na_2O$, 5.33 wt.% ignition loss and impurities is added onto the meniscus of molten steel in a mold. The mold powder is melted into a vitreous state by heat from the molten steel to cover the molten steel meniscus, and at the same time, penetrates into gaps between sides of solidified steel and the mold inner walls to cover the surface of cast strand. The molten steel and the cast strand are thus isolated from air and protected from oxidation. Furthermore, the molten mold powder layer absorbs non-metallic inclusions floating up on the molten steel meniscus.

On the other hand, an immersion nozzle is attached as a protrusion substantially vertically to the bottom of a tundish, and the lower portion thereof is immersed into the molten steel in the mold across the above-mentioned molten mold powder layer. The molten steel in the tundish flows down through the immersion nozzle and is teemed into the mold without being exposed to air except during the initial stage of teeming.

By using an immersion nozzle together with a mold powder, therefore, it is possible to effectively prevent such inconveniences as oxidation of molten steel in the mold and the cast strand extracted from the mold, occurrence of turbulence in the molten steel, entanglement of air, mold powder and slag, and molten steel splash, thereby giving a sound cast strand excellent in surface quality as well as in inner quality.

Amorphous silica, zircon-graphite and aluminagraphite refractories are known as materials for the above-mentioned immersion nozzle, and an immersion nozzle is manufactured by forming any of these refractories into a shape for example as shown in the schematic sectional view of FIG. 1, and firing said formed body.

In FIG. 1, 2 is a nozzle body, 3 is a collar portion, 7 is a bore, and 8 is an exit port. Molten steel in a tundish is teemed into a mold through the collar portion 3, the bore 7 and the exit port 8 of the immersion nozzle. The immersion nozzle, through the bore 7 of which high-temperature molten steel flows down, is exposed to radical temperature change and thermal shock particularly in the initial stage of teeming, and in addition, the bore 7 is eroded by molten steel. Furthermore, the portion of the outer surface of the nozzle body 2 in contact with the molten mold powder layer is most seriously eroded by molten steel and molten mold powder. Along with the recent trend toward larger continuous casters, molten steel of more than five batches of ladle is often continuously teemed for casting.

An immersion nozzle is therefore required to have various properties to meet the aforementioned severe service conditions. Among these properties, those which have the most important effect on the service life and should therefore be satisfied include spalling resistance in the initial stage of molten steel teeming, erosion resistance against molten steel and erosion resistance against molten mold powder. A nozzle which does not satisfy these three properties at the same time cannot withstand continuous teeming of molten steel of more than five batches of ladle into a mold.

However, all the above-mentioned amorphous silica, zirconia-graphite and alumina-graphite refractories have respective mertis and demerits, and it is very difficult to manufacture an immersion nozzle capable of withstanding the above-mentioned severe service conditions from a single kind of refractory selected from those mentioned above. More specifically, the amorphous silica refractory has a very small thermal expansion and a relatively satisfactory erosion resistance against molten mold powder as from 2 to 3 mm per cycle of continuous casting of molten steel of a batch of ladle. On the contrary, however, the amorphous silica refractory is susceptible to spalling because of transformation of amorphous silica during service for a long period of time, and has a relatively low erosion resistance against molten steel, particularly high-Mn molten steel. The zircon-graphite refractory has a relatively satisfactory erosion resistance against molten steel, while erosion resistance thereof against molten mold powder is problematic. The alumina-graphite refractory has a good erosion resistance against molten steel. The zircongraphite and alumina-graphite refractories, both containing graphite, have a high thermal conductivity and hence are capable of well withstanding radical temperature change and thermal shock. In contrast, however, the structure becomes porous as a result of oxidation and/or dissolution into molten steel of graphite, and erosion is caused by molten steel and molten mold powder penetrating into portions thus becoming porous, this forming a drawback common to these refractories.

With a view to solving the aforementioned problems and thus improving erosion resistance against molten steel and erosion resistance against molten mold powder as required for an immersion nozzle, the following immersion nozzles are proposed:

(1) An immersion nozzle for continuous casting disclosed in Japanese Patent Publication No. 28,568/74 of July 27, 1974, wherein:

As shown in the schematic sectional view given in FIG. 2, a highly erosion-resistant refractory layer made of a material such as zirconia refractory is arranged on at least one of the inner surface 10 of a bore 7 and an exit port 8 of a nozzle body 2 mainly comprising amorphous silica and the outside portion 1' of said nozzle body 2 in contact with a molten mold powder layer, so as to be flush with the inner and outer surfaces of said nozzle body 2; and zirconia, silica-zirconia, zirconia-mullite, mullite and chromium oxide refractories are suitable as said highly erosion-resistant refractory (hereinafter referred to as the "prior art (1)").

In the prior art (1), the nozzle body 2 comprises mainly amorphous silica. Amorphous silica has a very small thermal expansion and a relatively satisfactory erosion resistance against molten mold powder, as mentioned above, while having a relatively low erosion resistance against molten steel.

Also in the prior art (1), zirconia ($ZrO_2$) which is the main material of the refractory layer(s) arranged on the portion indicated by 10 in the bore 7 of the nozzle body 2 and/or on the portion indicated by 1' on the outside portion of the nozzle body 2 has an excellent erosion resistance against molten mold powder. However, in firing, there occurs a considerable difference in thermal expansion between the arranged refractory layer(s) 10 and/or 1' having a high thermal expansion and the nozzle body 2 comprising amorphous silica having a very small thermal expansion, and as a result, spalling may be caused in both the nozzle body 2 and the portion(s) 10 and/or 1'. It is thus difficult to obtain an immersion nozzle free from a defect.

It is therefore difficult for the immersion nozzle of the prior art (1) to withstand severe service conditions including continuous casting of molten steel of more than five batches of ladle.

(2) An immersion nozzle for continuous casting disclosed in Japanese Patent Provisional Publication No. 46,522/73 of July 3, 1973, wherein:

A refractory layer excellent in erosion resistance against molten mold powder is arranged on the entire surface of the nozzle body comprising a refractory excellent in erosion resistance against molten steel or on the outside portion thereof in contact with a molten mold powder layer, so as to be flush with the outer surface of said nozzle body, or, to form a protrusion from the outer surface of said nozzle body; alumina-graphite refractory is suitable as said refractory excellent in erosion resistance against molten steel, and amorphous silica refractory is suitable as said refractory excellent in erosion resistance against molten mold powder (hereinafter to as the "prior art (2)").

In the prior art (2), the nozzle body comprises mainly alumina-graphite as in the present invention described later. As mentioned above, alumina-graphite is excellent in erosion resistance against molten steel.

Also, in the prior art (2), the main material for the refractory layer arranged on the outside portion of the nozzle body is amorphous silica. As described above, amorphous silica has a relatively satisfactory erosion resistance against molten mold powder, while having a low erosion resistance against molten steel, especially high-Mn molten steel. In addition, amorphous silica is susceptible to spalling because of transformation of amorphous silica during service for a long period of time.

Therefore, the immersion nozzle of the prior art (2) obtained by arranging an amorphous silica refractory layer having a low erosion resistance against molten steel on the outside portion of the nozzle body in contact with molten mold powder layer is problematic in erosion resistance against molten steel and it is difficult for such an immersion nozzle to continuously cast molten steel of more than five batches of ladle.

(3) An immersion nozzle for continuous casting disclosed in Japanese Patent Utility Model Provisional Publication No. 53,415/75 of May 22, 1975, wherein:

As shown in the schematic sectional view given in FIG. 3, the portion 1'' of a nozzle body 2 susceptible to local erosion in contact with a molten mold powder layer, or said portion 1'' and a portion 1''' immediately therebelow (i.e., 1''+1''') are formed with a zirconia-graphite refractory or an $MgO.Al_2O_3$ spinel-graphite refractory; and the remaining portion of said nozzle body 2 is formed with an alumina-graphite refractory; said zirconia-graphite refractory having preferably the following chemical composition:

Carbon (C): from 15 to 30 wt.%,
Zirconia ($ZrO_2$): from 30 to 70 wt.%, and,
Silica ($SiO_2$): up to 20 wt.%;

and said $MgO.Al_2O_3$ spinel-graphite refractory having preferably the following chemical composition:

Carbon (C): from 20 to 30 wt.%,
Silica ($SiO_2$): up to 10 wt.%,
Magnesia (MgO): from 30 to 65 wt.%,
Alumina ($Al_2O_3$): from 10 to 40 wt.%, and
Others: up to 5 wt.%; (hereinafter referred to as the "prior art (3)").

In FIG. 3, 7 is a bore, and 8 is an exit port. The immersion nozzle of the prior art (3) is common with the immersion nozzle of the present invention described later in that the refractory used for the portion 1'' of the nozzle body in contact with a molten mold powder layer and the portion 1''' immediately therebelow consists essentially of carbon (C), zirconia ($ZrO_2$) and silica ($SiO_2$). However, in the prior art (3), the carbon content is as high as from 15 to 30 wt.%. Consequently, the structure of the refractory becomes porous as a result of oxidation and/or dissolution into molten steel of carbon, and molten steel and molten mold powder penetrating into portions thus becoming porous causes erosion of zirconia, thus accelerating erosion of the portion of the immersion nozzle in contact with molten mold powder layer.

It is therefore difficult for the immersion nozzle of the prior art (3) also to withstand severe service conditions including continuous casting of molten steel of more than five batches of ladle.

SUMMARY OF THE INVENTION

An object of the present invention is therefore to provide an immersion nozzle which, when continuously casting molten steel, can withstand a long service, especially continuous casting of molten steel of more than five batches of ladle.

A principal object of the present invention is to provide an immersion nozzle, of which the outside portion in contact, when continuously casting molten steel, with a molten mold powder layer on the meniscus of molten steel in a mold is excellent not only in erosion resistance against molten steel but also especially in erosion resistance against molten mold powder.

In accordance with one of the features of the present invention, there is provided an immersion nozzle for continuous casting of molten steel, which comprises:

a nozzle body comprising an alumina-graphite refractory and a refractory layer excellent in erosion resistance against a molten mold powder, said refractory layer being arranged so as to be integral with said nozzle body and flush with the outer surface of said nozzle body at the outside portion of said nozzle body in contact, when the lower portion of said immersion nozzle being immersed into molten steel in a mold, with a molten mold powder layer on the meniscus of said molten steel;

said immersion nozzle being characterized in that:

said refractory layer arranged at said outside portion of said nozzle body consists essentially of, in weight percentage:

Carbon (C): from 2 to 10%,

Zirconia ($ZrO_2$): from 70 to 90%,

At least one compound selected from the group consisting of silicon carbide (SiC) and amorphous silica ($SiO_2$) from 5to 27%, and, Incidental impurities up to 3%.

DETAILED DESCRIPTION OF PREFERRED EMBODIMENTS

From the aforementioned point of view, I have carried out extensive studies to obtain an immersion nozzle capable of withstanding a long service, especially continuous casting of molten steel of more than five batches of ladle. As a result, I found that it is possible to obtain an immersion nozzle capable of withstanding continuous casting of molten steel of more than five batches of ladle by forming a nozzle body with an alumina-graphite, and arranging, at the outside portion of said nozzle body in contact, when immersed into molten steel, with a molten mold powder layer on the meniscus of said molten steel, a refractory layer consisting essentially of:

Carbon (C): from 2to 10%,

Zirconia ($ZrO_2$): from 70 to 90%,

At least one compound selected from the group consisting of silicon carbide (SiC) and amorphous silica ($SiO_2$): from 5 to 27%, and, Incidental impurities: up to 3%, so as to be integral with said nozzle body and flush with the outer surface of said nozzle body.

Figure 4:
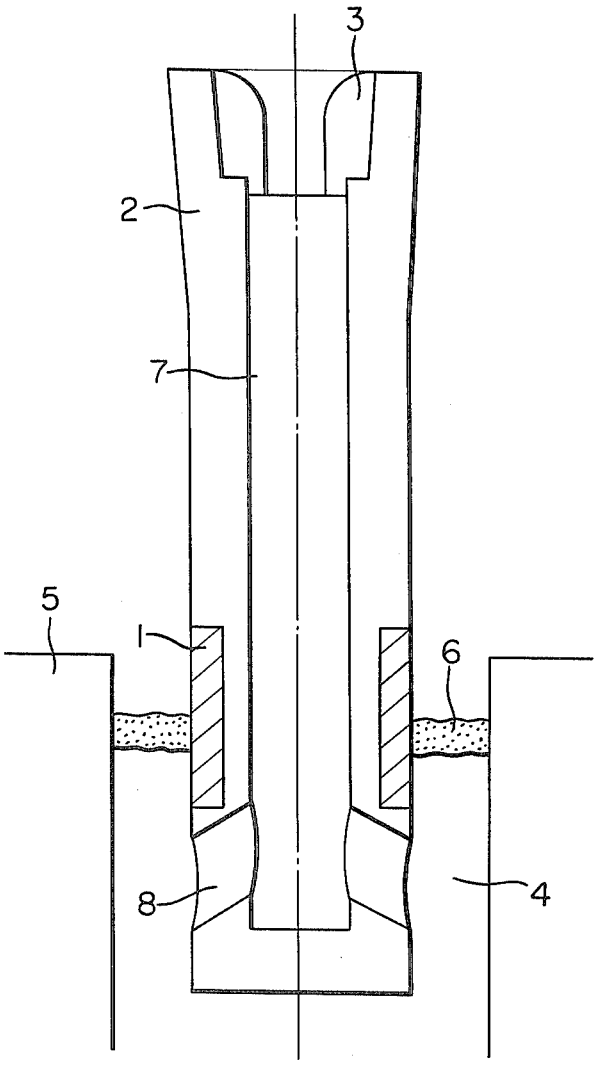

FIG. 4 is a schematic sectional view illustrating an embodiment of the immersion nozzle for continuous casting of molten steel of the present invention. In FIG. 4, 2 is a nozzle body, 1 is a refractory layer arranged at the outside portion of the nozzle body 2 in contact with a molten mold powder layer 6 on the meniscus of molten steel 4 in a mold 5, 3 is a collar portion of the nozzle body 2, 7 is a bore of the nozzle body 2, and 8 is an exit port of the bore 7. Molten steel in a tundish (not shown) is deemed into the mold 5 through the collar portion 3, the bore 7 and the exit port 8 while the flow rate of molten steel is adjusted by a stopper (not shown).

The nozzle body 2 may be made of an alumina-graphite refractory having a known chemical composition, or more preferably, an alumina-graphite refractory having, for example, any of the following chemical compositions: from 48.0 to 51.0 wt.% alumina, from 19.0 to 21.0 wt.% carbon and from 28.0 to 31.0 wt.% balance; or, from 44.0 to 48.0 wt.% alumina, from 25.0 to 28.0 wt.% carbon, and from 26.0 to 29.0 wt.% balance. An alumina-graphite refractory is excellent in erosion resistance against molten steel and has a high thermal conductivity because of carbon contained. Therefore, the bore 7, the exit port 8 and the portion immersed into molten steel of the nozzle body 2 are less susceptible to erosion by molten steel, exposed to reduced temperature change and thermal shock in the initial stage of teeming of molten steel and protected from occurrence of spalling.

In the present invention, the reasons of limiting the chemical composition of the refractory layer 1 arranged at the outside portion of the nozzle body 2 in contact with the molten mold powder layer 6 as mentioned above are as follows:

(1) Carbon (C):

Carbon (C) has the effect of not only raising the thermal conductivity but also reducing the thermal expansivity of a refractory. Furthermore, carbon has the effect of improving spalling resistance and wetting resistance against molten steel of a refractory. However, with a carbon content of under 2 wt.%, a desired effect cannot be obtained as mentioned above. The carbon content should therefore be at least 2 wt.%. On the other hand, with a carbon content of over 10 wt.%, carbon is partially oxidized and dissolved into molten steel, and as a result, the refractory becomes porous. Molten steel and molten mold powder penetrating into portions thus becoming porous erode zirconia as described later. The carbon content should therefore be up to 10 wt.%. Carbon may be either graphite or amorphous carbon.

(2) Zirconia ($ZrO_2$):

Zirconia ($ZrO_2$) is added to prevent erosion by a molten mold powder because of the very high erosion resistance thereof against molten mold powder. However, with a zirconia content of under 70 wt.%, a desired erosion resistance against molten mold powder cannot be obtained. The zirconia content should therefore be at least 70 wt.%. On the other hand, because of the high thermal expansivity of zirconia, a zirconia content of over 90 wt.% tends to cause spalling in the initial stage of molten steel teeming. The zirconia content should therefore be up to 90 wt.%. Any of stabilized zirconia and nonstabilized zirconia may be used.

(3) Silicon carbide (SiC) and amorphous silica ($SiO_2$):

As mentioned above, carbon tends to be oxidized and dissolved into molten steel. To compensate this inconvenience, therefore, silicon carbide (SiC) which is a stable carbide is added, as required, in place of a part of carbon to be added. More specifically, becausesilicon carbide has an advantage of being less susceptible to oxidation, and furthermore, because, even if oxidized, a silica film is formed and prevents oxidation or dissolution into molten steel of carbon, silicon carbide is useful for reducing the tendency of a refractory to become porous under the effect of oxidation and dissolution into molten steel of carbon. Also, because of the relatively high thermal conductivity of silicon carbide, it is possible to improve the thermal conductivity of a refractory by adding silicon carbide.

Amorphous silica ($SiO_2$) has a very small thermal expansivity. Amorphous silica is therefore added, as required, for the purpose of reducing the thermal expansivity of a refractory by alleviating the high thermal expansivity of zirconia. In addition, amorphous silica is excellent in erosion resistance against molten mold powder.

However, with a silicon carbide content and/or an amorphous silica content of under 5 wt.%, a desired effect cannot be obtained as mentioned above. Therefore, the silicon carbide content and/or the amorphous silica content should be at least 5 wt.%. On the other hand, with a silicon carbide content and/or an amorphous silica content of over 27 wt.%, the aforementioned zirconia content is relatively reduced, thus making it impossible to obtain a desired erosion resistance against molten mold powder. Therefore, the silicon carbide content and/or the amorphous silica content should be up to 27 wt.%.

When, for example, the nozzle body has a thickness of from 20 to 25 mm, the thickness of the refractory layer having the above-mentioned chemical composition arranged at the outside portion of the nozzle body in contact with molten mold powder layer has only to be from 10 to 15 mm.

Now, the immersion nozzle of the present invention is described in more detail with reference to examples:

EXAMPLE 1

A conventional alumina-graphite refractory was used as the material for a nozzle body 2 as shown in FIG. 4. A refractory comprising:

Graphite: 3 wt.%,
Nonstabilized zirconia: 72 wt.%
Silicon carbide: 15 wt.%, and
Amorphous silica: 10 wt.% mixed with tar and pitch as binders was used as the material for the outside portion 1 of the nozzle body 2 in contact with the molten mold powder layer 6. These refractories were formed by a conventional rubber press method and fired, and as shown in FIG. 4, an immersion nozzle was prepared, in which a refractory layer excellent in erosion resistance against molten mold powder was integrally arranged at the outside portion 1 of the nozzle body 2 in contact with the molten mold powder layer 6.

Then, an aluminum-killed steel in an amount of six batches of 250-ton ladle was continuously teemed into two strands with the use of the immersion nozzle thus prepared. The outside portion 1 of the immersion nozzle in contact with the molten mold powder layer 6 showed on one side an erosion of only 10 mm.

Figure 1:
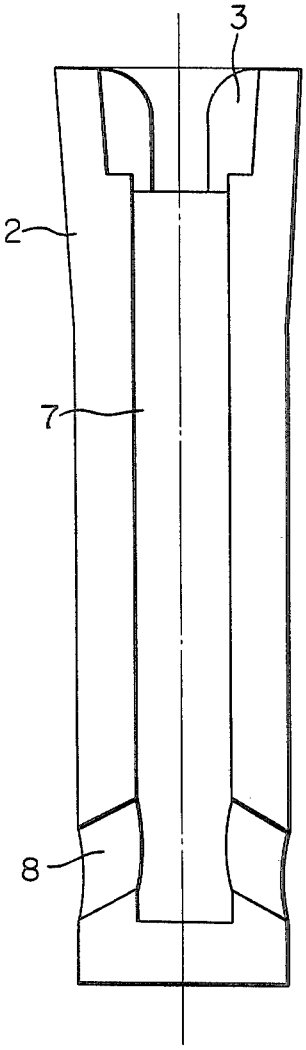
FIG. 1 PRIOR ART
FIG. 1 is a schematic sectional view illustrating a conventional immersion nozzle for continuous casting of molten steel.
Figure 2:
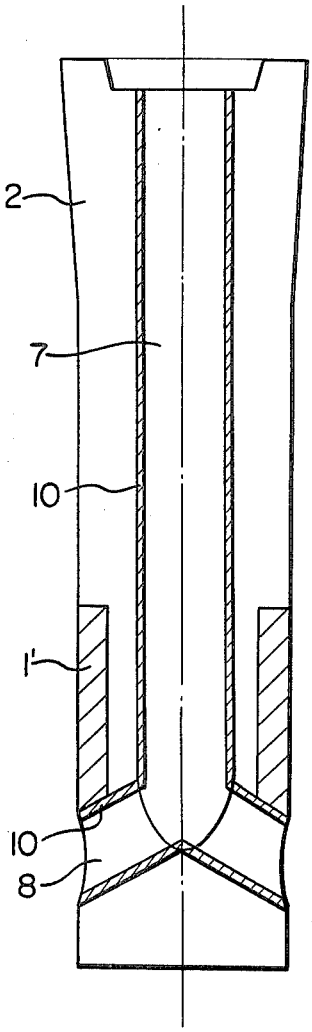
FIG. 2 PRIOR ART
FIG. 2 is a schematic sectional view illustrating another conventional immersion nozzle for continuous casting of molten steel.
Figure 3:
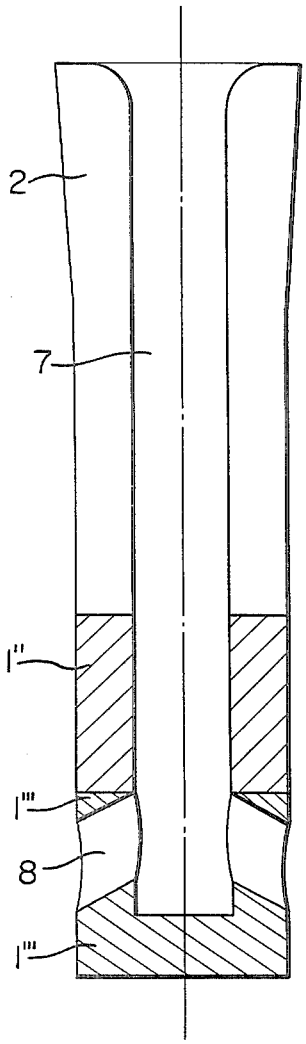
FIG. 3 PRIOR ART
FIG. 3 is a schematic sectional view illustrating further another conventional immersion nozzle for continuous casting of molten steel; and, FIG. 4 is a schematic sectional view illustrating the immersion nozzle for continuous casting of molten steel of the present invention.

For comparison, on the other hand, an aluminum-killed steel in an amount of three batches of 250-ton ladle was continuously teemed into two strands with the use of a conventional immersion nozzle as shown in FIG. 1 made from a single kind of alumina-graphite refractory. The outside portion of the immersion nozzle in contact with the molten mold powder layer showed on one side such a serious erosion as 25 mm, and it was impossible to further continue continuous casting.

EXAMPLE 2

An immersion nozzle was prepared under the same conditions as in Example 1, which had the same construction as the immersion nozzle in Example 1 except that a refractory comprising:

Graphite: 2wt.%,
Silicon carbide: 10 wt.%, and
Stabilized zirconia by MgO: 88 wt.% mixed with phenol resin as the binder was used as the material for the outside portion 1 of the nozzle body 2 in contact with the molten mold powder layer 6.

Then, an aluminum-silicon-killed steel in an amount of eight batches of 100-ton ladle was continuously teemed into one strand with the use of the immersion nozzle thus prepared. The outside portion 1 of the immersion nozzle in contact with the molten mold powder layer 6 showed on one side an erosion of 16 mm, permitting use at ease.

For comparison, on the other hand, an aluminum-silicon-killed steel in an amount of three batches of 100-ton ladle was continuously teemed into one strand with the use of a conventional immersion nozzle made from the same single kind of alumina-graphite refractory as in Example 1. The immersion nozzle with a thickness of 30 mm was broken by melting.

According to the present invention, as described above in detail, it is possible to obtain an immersion nozzle for continuous casting of molten steel, which can withstand casting of molten steel of more than five batches of ladle and has a service life from two to three times as long as that of a conventional immersion nozzle, thus providing industrially useful effect.

I claim:

1. An immersion nozzle for continuous casting of molten steel, which comprises:

a nozzle body comprising an alumina-graphite refractory and a refractory layer excellent in erosion resistance against a molten mold powder, said refractory layer being arranged so as to be integral with said nozzle body and flush with the outer surface of said nozzle body at the outside portion of said nozzle body in contact, when the lower portion of said immersion nozzle is being immersed into molten steel in a mold, with a molten mold powder layer on the meniscus of said molten steel;

said immersion nozzle being characterized in that:

said refractory layer arranged at said outside portion of said nozzle body consists essentially of, in weight percentage:

Carbon (C): from 2to 10 %,
Zirconia ($ZrO_2$): from 70 to 90%,
At least one compound selected from the group consisting of silicon carbide (SiC) and amorphous silica ($SiO_2$): from 5to 27 %, and,
Incidential impurities up to 3%.

* * * * *

UNITED STATES PATENT AND TRADEMARK OFFICE

CERTIFICATE OF CORRECTION

PATENT NO. : 4,210,264

DATED : July 1, 1980

INVENTOR(S) : MASANO KONDO

It is certified that error appears in the above—identified patent and that said Letters Patent is hereby corrected as shown below:

Column 1, line 12: after "Japanese Patent", delete "Utility Model";

line 14: after "Japanese Patent", insert --Utility Model--.

Column 1, line 6: rewrite "PERTIENT" as --PERTINENT--.

Column 3, line 50: after "hereinafter", insert --referred--.

Column 6, line 56: rewrite "becausesilicon" as --because silicon--.

Column 8, line 9: rewrite "2wt.%" as --2 wt.%--.

Column 8, line 58 (Claim 1): rewrite "Incidential" as --Incidental--.

Signed and Sealed this

*Twenty-fourth* Day of *January 1984*

[SEAL]

*Attest:*

GERALD J. MOSSINGHOFF

*Attesting Officer*

*Commissioner of Patents and Trademarks*